US008763285B2

(12) United States Patent
Budzar et al.

(10) Patent No.: US 8,763,285 B2
(45) **Date of Patent: *Jul. 1, 2014**

(54) INTERACTIVE ELECTRONIC GREETING CARDS WITH TAP AND TOUCH ACTIVATED EFFECTS

(75) Inventors: Lauren Budzar, Seven Hills, OH (US); Gary Nelson, Avon, OH (US); Melissa Sapp, Avon Lake, OH (US); Melissa Flesher, Avon, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/613,101

(22) Filed: Sep. 13, 2012

(65) Prior Publication Data

US 2013/0000166 A1 Jan. 3, 2013

Related U.S. Application Data

(60) Continuation-in-part of application No. 13/090,569, filed on Apr. 20, 2011, now Pat. No. 8,584,385, and a continuation-in-part of application No. 13/459,553, filed on Apr. 30, 2012, now abandoned, which is a division of application No. 13/004,544, filed on Jan. 11, 2011, now Pat. No. 8,205,365.

(51) Int. Cl.
*G09F 1/00* (2006.01)
*B42D 15/02* (2006.01)

(52) U.S. Cl.
CPC ..... *B42D 15/022* (2013.01)
USPC ..... 40/124.03

(58) Field of Classification Search
USPC ..... 40/124.03, 124.01, 124.02, 124.07
See application file for complete search history.

(56) References Cited

U.S. PATENT DOCUMENTS

| | | | | | |
|---|---|---|---|---|---|
| 4,299,041 | A | * | 11/1981 | Wilson | 40/124.02 |
| D317,623 | S | * | 6/1991 | Piechocki | D19/1 |
| 5,063,698 | A | * | 11/1991 | Johnson et al. | 40/124.03 |
| 5,504,836 | A | | 4/1996 | Loudermilk | |
| 5,680,718 | A | * | 10/1997 | Ratcliffe et al. | 40/329 |
| 5,956,682 | A | | 9/1999 | Loudermilk et al. | |
| 6,185,851 | B1 | | 2/2001 | Loudermilk et al. | |
| 6,845,583 | B2 | * | 1/2005 | Lee | 40/717 |
| 7,802,386 | B2 | * | 9/2010 | Mandelbaum et al. | 40/124.03 |
| 7,840,017 | B2 | | 11/2010 | Isetani et al. | |
| 2002/0040298 | A1 | | 4/2002 | Loudermilk et al. | |
| 2002/0046034 | A1 | | 4/2002 | Loudermilk et al. | |
| 2008/0289230 | A1 | * | 11/2008 | Mandelbaum et al. | 40/124.01 |
| 2009/0126242 | A1 | | 5/2009 | Clegg et al. | |

(Continued)

FOREIGN PATENT DOCUMENTS

| | | |
|---|---|---|
| WO | WO 2009/127858 | 10/2009 |
| WO | WO 2010/013061 | 2/2010 |
| WO | WO 2010/013062 | 2/2010 |

*Primary Examiner* — Kristina Junge
(74) *Attorney, Agent, or Firm* — Christine Flanagan

(57) ABSTRACT

The interactive greeting card of the present disclosure and related inventions combines a traditional paper card with one or more special effects that are initiated by interaction between a user and the greeting card. One or more touch sensors are used to initiate effects including, but not limited to sound, light, movement or a combination thereof.

19 Claims, 6 Drawing Sheets

(56) References Cited

U.S. PATENT DOCUMENTS

| | | | | |
|---|---|---|---|---|
| 2009/0308924 | A1 | 12/2009 | Wallace et al. | |
| 2009/0309303 | A1 | 12/2009 | Wallace et al. | |
| 2010/0151830 | A1 | 6/2010 | Raffle | |
| 2010/0250255 | A1 | 9/2010 | Stern | |
| 2010/0308981 | A1* | 12/2010 | Lien et al. | 340/384.1 |
| 2011/0146126 | A1* | 6/2011 | Phillips | 40/738 |
| 2011/0167685 | A1* | 7/2011 | Taylor et al. | 40/124.03 |
| 2013/0074380 | A1* | 3/2013 | Mayer et al. | 40/124.03 |

* cited by examiner

INTERACTIVE ELECTRONIC GREETING CARDS WITH TAP AND TOUCH ACTIVATED EFFECTS

RELATED APPLICATIONS

This application is a continuation-in-part of and claims priority to U.S. patent application Ser. No. 13/090,569, filed on Apr. 20, 2011. This application also claims priority to U.S. patent application Ser. No. 13/459,553, filed on Apr. 30, 2012, which claims priority to U.S. patent application Ser. No. 13/004,544, filed on Jan. 11, 2011. Each of the applications listed above are incorporated herein by reference in its entirety.

FIELD OF THE INVENTION

The present invention is in the field of personalized greeting devices, greeting cards and social expression products, and more particularly to greeting cards with interactive electronic functions including tap and/or touch sensitive sound or device activation.

BACKGROUND OF THE INVENTION

Traditional paper greeting cards have been widely used for celebratory occasions such as birthdays, graduations, weddings, and for other commercial purposes. More recently, the market has expanded with greeting cards that attempt to capture attention by alternate designs and other features to enhance the communicative and entertainment value of social and relational greetings. The widespread availability of compact digital electronics has made incorporation into social communication products economical. Although the prior art includes greeting cards with sound-generating features, such cards are generally available only in a fixed format wherein a sound file is played upon activation by manipulation of the card. The prior art generally lacks social expression products such as greeting cards with electronic functions with which a user such as a recipient of the card can activate and use in various interactive manners.

SUMMARY OF THE INVENTION

An interactive greeting card comprising a greeting card body having a plurality of greeting card panels, two of the greeting card panels forming and enclosed cavity, an electronics module contained within the enclosed cavity of the greeting card body comprising a circuit board, integrated circuit, touch sensor switch, a speaker, a memory storage device, a power source, a switch, a touch sensor switch plate and at least two digital audio files saved on the memory storage device. A first switch initiates playback of a first digital audio file upon opening the greeting card and a second switch initiates playback of a second digital audio file upon human contact with an area of the greeting card that is directly above the touch sensor switch plate.

DETAILED DESCRIPTION OF PREFERRED AND ALTERNATE EMBODIMENTS

The interactive electronic greeting card of the present disclosure and related inventions combines a traditional paper greeting card with one or more special effects that are initiated by interaction between a user and the greeting card. One or more touch sensors (hereinafter referred to interchangeably as "touch sensor", "touch switch", "touch sensitive switch" and "touch sensitive sensor") are used to initiate effects including, but not limited to sound, light and/or movement. For the purpose of describing the invention, the embodiments described herein are directed to greeting cards with touch activated sound, however, it should be noted that the scope of the invention includes other touch activated effects such as light, motorized movement, and other such effects, or a combination thereof.

Figure 1:
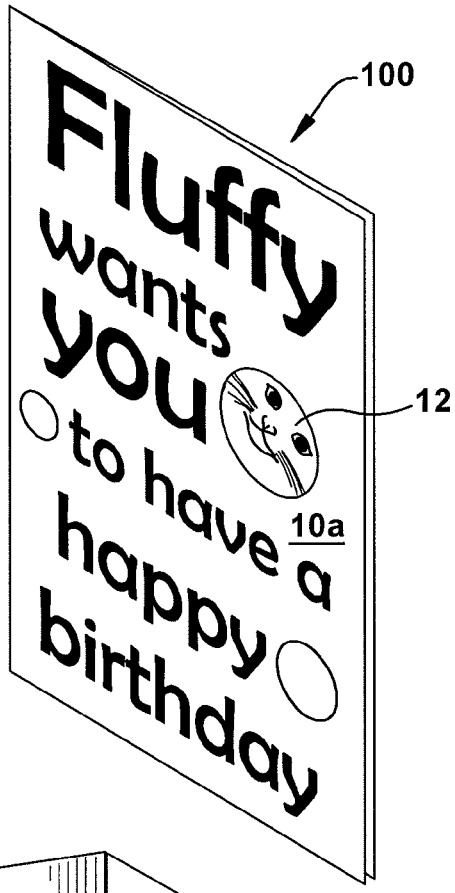
FIG. 1 is a perspective view of a representative embodiment of an interactive greeting card of the present invention, in a closed position.
Figure 2:
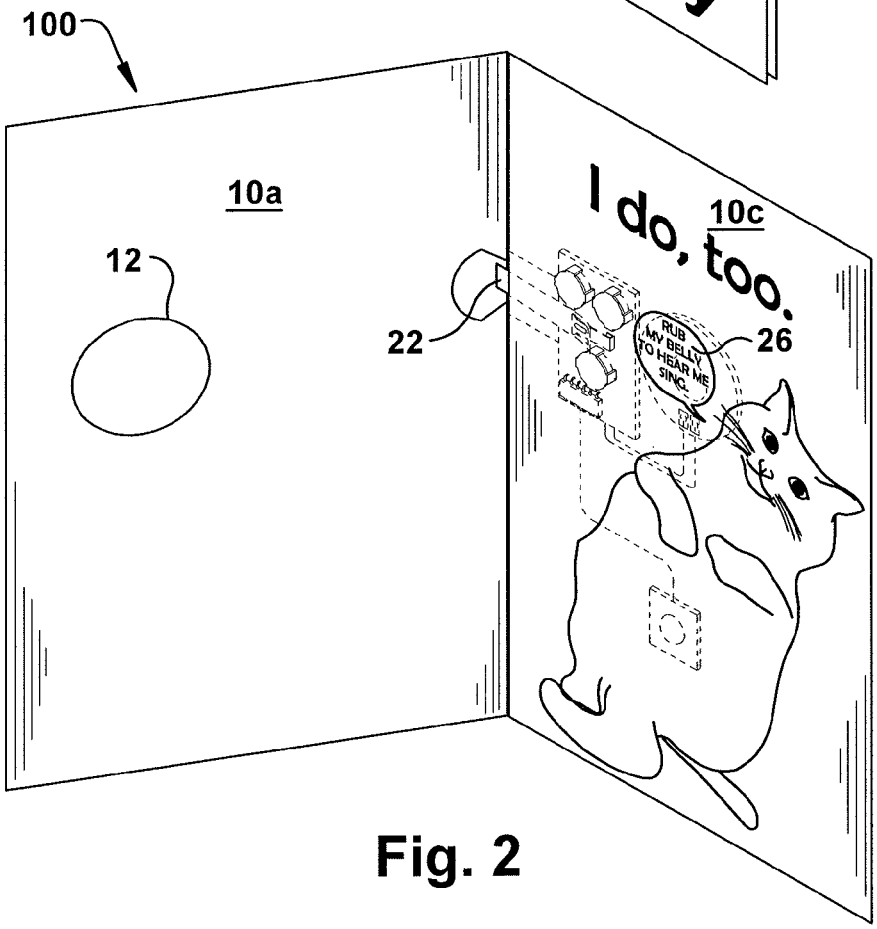
FIG. 2 is a perspective view of the interactive greeting card of FIG. 1, in an open position.
Figure 3:
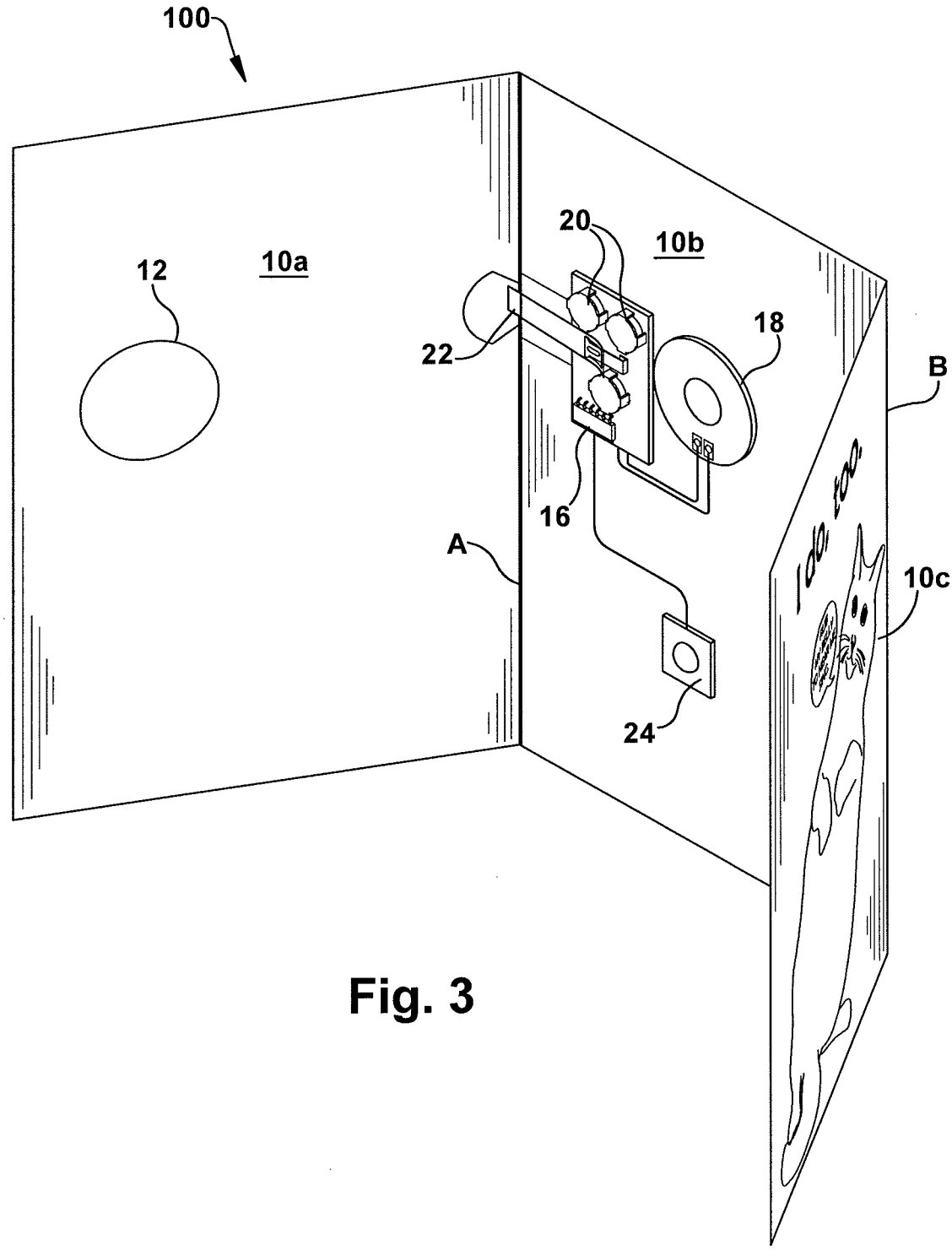
FIG. 3 is a perspective view of the interactive greeting card of FIG. 1, in a semi-assembled position.
Figure 4:
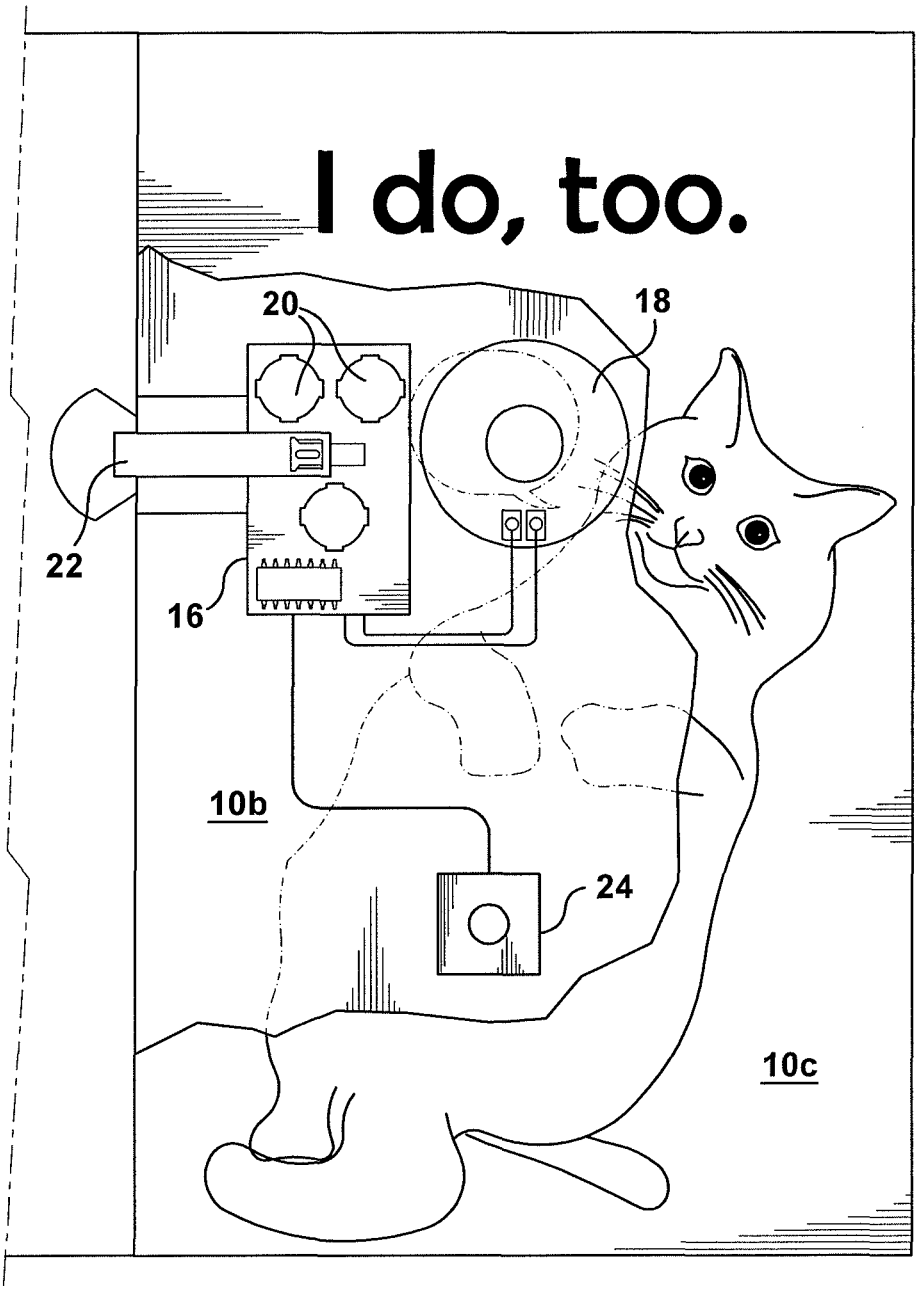
FIG. 4 is a front view of the interactive greeting card of FIG. 1 with tear-away.

In a preferred embodiment, the greeting card body includes a first panel 10*a* connected to a second panel 10*b* along a first fold line A and a third panel 10*c* connected to the second panel 10*b* along a second fold line B, as shown in FIG. 3. The greeting card panels 10*a*, 10*b*, 10*c* may be made of paper, paperboard, cardboard, or any other suitable material. Each of the panels contains a front surface and a back surface opposite the front surface. Various electronic components are attached to back surface of either the second 10*b* or third panel 10*c*. Once the electronic components are installed, the third panel 10*c* is folded over the second fold line B to lie atop the second panel 10*b*. The third panel 10*c* is then sealed, adhesively or otherwise, to the second panel 10*b* around each of the outer edges of the panel, thereby forming an enclosed cavity therebetween, as shown in FIG. 4. The electronic components are then contained and concealed within the cavity formed between the second 10*b* and third panels 10*c*. The greeting card 100 then operates as a typical two panel greeting card with the first panel 10*a* serving as the front panel and the attached second 10*b* and third 10*c* panels serving as the back panel, as shown in FIGS. 1 and 2.

Figure 5:
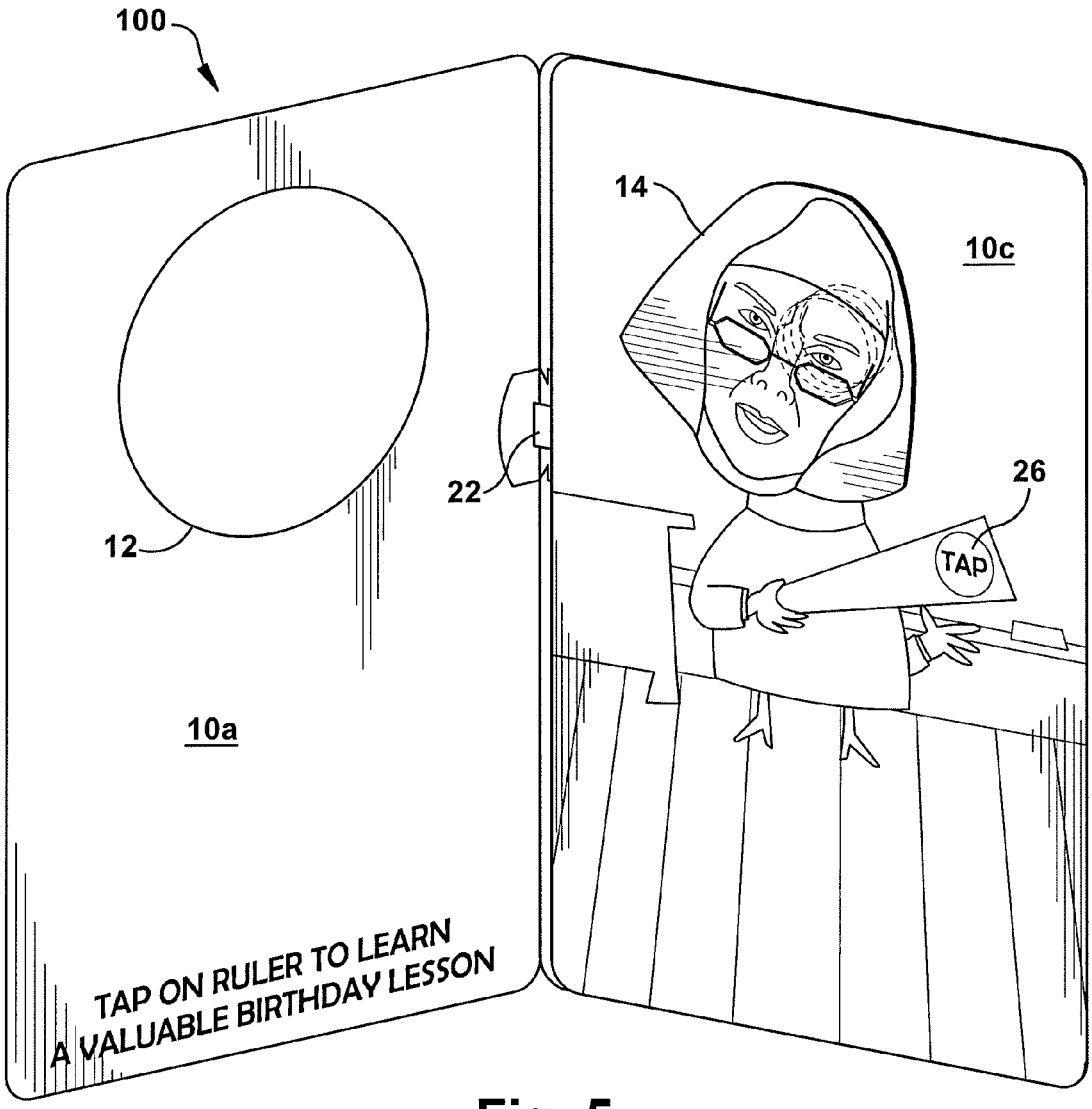
FIG. 5 is a perspective view of another embodiment of the interactive greeting card of the present invention.

The greeting card 100 is folded along the first fold line A so that the back surface of the front panel is facing the back surface of the back panel. To open the greeting card 100, the front panel is moved away from the back panel about the first fold line A and likewise (FIG. 2), to close the greeting card 100 front panel is moved towards the back panel along the first fold line A so that the panels 10*a*, 10*b*, 10*c* return to a stacked position (FIG. 1). While the representative embodiment of the greeting card 100 contains three panels 10*a*, 10*b*, 10*c* connected along two fold lines A, B, the greeting card body may contain any number of panels and fold lines that cooperate to form at least one internal cavity wherein the electronic components may be concealed. Additional features may be included in the greeting card body such as an opening or aperture 12 in the front panel 10*a* of the greeting card 100 that allows visibility to a portion of the inside or back panel 10*c* of the greeting card 100. The greeting card panels may also contain various embellishments, such as one or more separate die cut pieces 14 that are attached to the greeting card body to give the artwork a three-dimensional effect, as shown in FIG. 5. The one or more die cut pieces 14 may be attached to the greeting card body by a stationary piece of foam or other attachment mechanism that spans between the greeting card body and the die cut piece 14 or by a spring so that the die cut piece 14 can appear to bounce or bobble.

The electronic components (referred to collectively as "electronics module") of the greeting card 100 are concealed within the body of the greeting card 100, as described above. The electronics module contains various electronic components that are operative to initiate sound or other special effect upon contact with a touch sensor. The electronics module may contain components including, but not limited to, a circuit board with integrated circuit and controller 16, an integrated circuit with touch sensor, a speaker 18, a memory device, a power source 20, a switch 22, and a sensor switch plate 24. In a preferred embodiment, the sensor is a capacitance touch switch (hereinafter referred to interchangeably as "touch sensor", "touch switch"), which senses a change in the capacitance when a user (human) comes in contact with the switch plate surface 24 or an overlying material such as a panel of a card. When a user touches an area on the greeting card 100 directly above the switch plate 24, an increase in capacitance is detected thereby triggering the switch. Other types of touch sensitive switches may be used including a resistance touch switch or electronic ink. Also, other electronic components and related circuitry, which are known to one skilled in the art, may also be included.

In one embodiment, the interactive greeting card contains at least two digital audio files (hereinafter referred to interchangeably as "digital audio file", "audio file", "audio message", "message", or "recording") which are pre-loaded and stored within the electronics module. The digital audio files may contain a voice message, music, sounds or any other type of audio. A first digital audio file is automatically replayed upon opening the greeting card. A slide switch 22 is used to initiate playback of the first audio message. The slide switch 22 is located across the first fold line A between the first 10*a* and second 10*b* greeting card panels. When the greeting card 100 is in a closed position, with the first greeting card panel 10*a* atop the second greeting card panel 10*b*, the slide switch 22 prevents the completion of the circuit. When the greeting card 100 is opened by moving the first panel 10*a* away from the second panel 10*b* along the first fold line A, the slide switch 22 completes the circuit, initiating playback of a first audio file. The first digital audio file may contain spoken instructions informing the user where to touch the greeting card 100 to initiate playback of a second message or recording. For example, if the greeting card 100 contains a picture or drawing of a particular character, such as a celebrity or public figure, the initial audio file, which is triggered upon the user opening the greeting card 100, may contain a short message in the voice of the celebrity or public figure instructing the user where to touch, tap or otherwise contact the greeting card 100 to initiate the replay of a second message or recording. The second audio file may contain sound, music, or a second message in the voice of the celebrity or public figure.

The greeting card 100 may contain a sticker or printed indicia (hereinafter referred to as "touch indicator") 26 indicating where on the greeting card 100 a user should touch in order to receive a second message or playback of a second audio file. This touch indicator 26 may be placed directly above the touch sensor switch plate 24 (shown in FIG. 5) or it may be contained anywhere on the greeting card 100 as long as it directs the user to the portion of the greeting card 100 that must be touched in order to initiate the second message. If the touch indicator 26 is placed directly above the switch plate 24 (FIG. 5), then the surface area of the switch plate 24 is larger than the touch indicator 26 so that a touch or tap on or very near to the touch indicator 26 results in playback of the second audio file. A single touch or tap on the touch indicator 26 initiates playback of the second message. In a preferred embodiment, in order for playback of the second message, greeting card 100 must be in an open position. Therefore, if the second message has been initiated by a tap on the touch indicator 26, the second message will continue to completion unless the greeting card 100 is closed during playback. This prevents playback of the second message before the first message by inadvertent or accidental contact with the touch sensor switch plate 24. Also, initiation of the second audio message (by touching or tapping the indicated area) will cause the first audio message to cease if the second audio message is initiated before the first audio message is complete.

In another embodiment, instead of a single touch or tap initiating playback of the second audio file, as described above, the touch sensor requires constant user interaction to replay the entirety of the second audio file. For example, if the greeting card 100 contains a picture of a cat or dog, the first audio file (initiated by a slide switch 22 upon opening the greeting card) may contain sounds of a cat meowing or a dog barking. A touch indicator 26 printed on the greeting card may instruct the user to "rub my belly" or "pet me" at a specific position on the greeting card 100. When the user rubs this area, the second audio file is played back, which may include a cat meowing or dog barking to the tune of "Happy Birthday". However, the user must continue to rub or continuously touch the area of the touch indicator 26 to keep the second audio message playing. If the user stops rubbing the card in the indicated area, the second audio message will stop. If the user then starts to rub the area again, the audio will pick up where it left off when the user ceased contact. If the user stops rubbing the area and closes the card, the second audio will start back at the beginning when the greeting card is re-opened and contact is then re-initiated. If the user opens the card and begins rubbing the card as directed by the touch indicator 26, the second message will continue playing on a loop as long as the user continues contact with the touch sensor. In this embodiment, a single touch or tap on area directed by the touch indicator 26 is not enough to initiate playback of the second audio file. A user must rub or apply continual movement of a finger or fingers over the touch indicator area to continue playback of the second audio file. As described above, the slide switch 22 must complete the circuit (greeting card in an open position) in order for either the first or second audio message to play. This prevents inadvertent playback of the second message prior to playback of the first message. Also, initiation of the second audio file (by rubbing the indicated area) will cause the first audio file to cease if the second audio file is initiated before the first audio file is complete.

In an alternate embodiment, the volume or speed of the second audio message may be increased or decreased depending on the speed at which the user rubs (or otherwise provides a constant back and forth motion) over the surface of the greeting card at the touch indicator. For example, the greeting car may contain a picture or drawing of a guitar on the touch indicator. The user must rub or "strum" the guitar in order to hear the second audio file. If the user rubs in a fast, quick paced motion, the volume of the guitar and/or the speed of the music will be fast and quick paced. Decreasing the speed at which the user rubs or strums the guitar, will cause the audio to decrease in speed and/or volume.

In still another embodiment, the interactive greeting card contains a plurality of touch sensors and a plurality of corresponding digital audio files. Touching on certain areas of the card will trigger different audio message. For example, the greeting card may contain artwork showing several different animals. Beneath each animal is a different touch sensor switch plate. When the user touches a particular animal, the sound the animal makes is played back. Selecting a different animal will reveal a different sound.

In yet another embodiment, the interactive greeting card may contain additional electronic components such as a microphone, to enable a user to record a personal message that is saved played back upon the user touching a specific indicated area of the greeting card.

Figure 6:
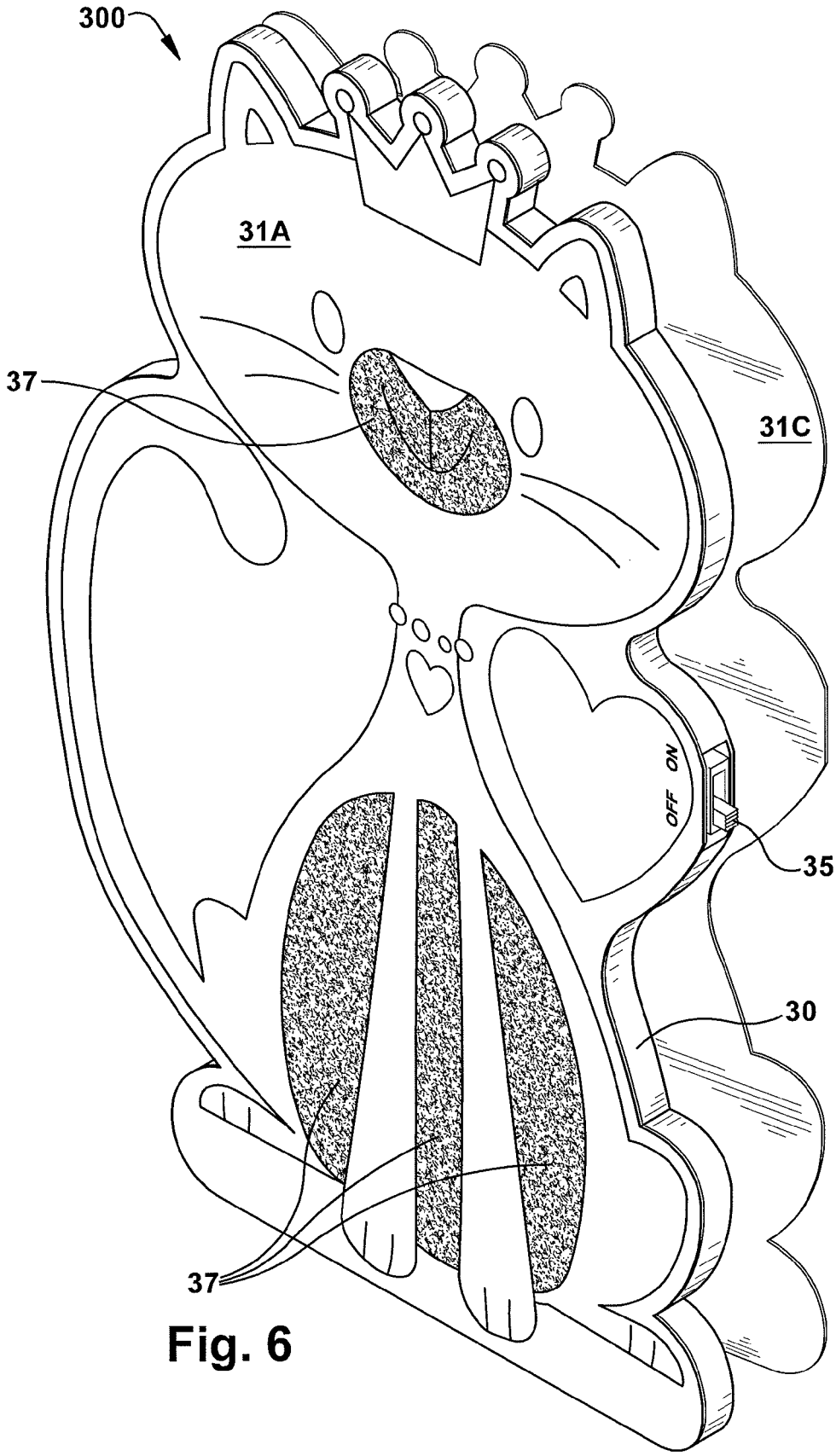
FIG. 6 is a perspective view of an alternate embodiment of the interactive greeting card of the present invention.
Figure 7:
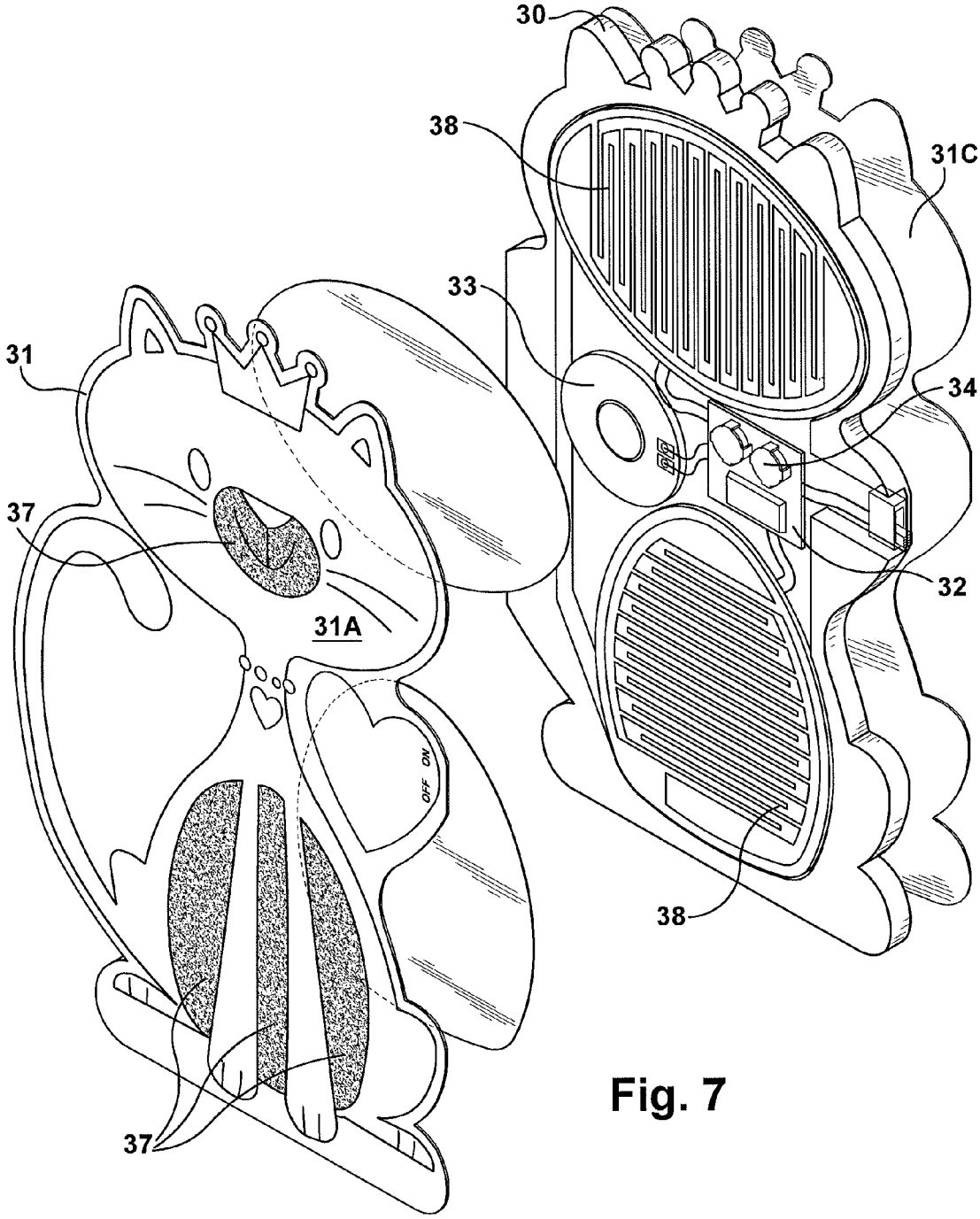
FIG. 7 is an exploded view of the interactive greeting card of FIG. 6.

In still another embodiment, shown in FIGS. 6 and 7, the greeting card body 30 is made of foam or foam-like material having a front surface, a back surface and a perimeter surface therebetween. The foam may be shaped in any way, such as like a cat, as shown in the figures. The foam body 30 may contain one or more cavities therein to house electronic or other greeting card components. The foam body 30 may be a singular piece of foam or may include two or more separate pieces of foam. A front planar surface material 31A is placed over the front surface of the foam body 30 and a back planar surface material is placed over the back surface of the foam body 30. In a preferred embodiment, the foam perimeter is uncovered and exposed. The front and back planar surface material 31 is preferably a heavy gauge paper-like material such as cardstock, cardboard or any other sheet or planar material. The planar surface material 31 may have printed material thereon, such as text sentiment or graphics. For example, in the example shown, the front surface material 31A contains graphics which represent the front of a cat and the back surface material may contain graphics which represent the back of a cat. The surface material 31 may also contain various embellishments attached thereto, such as gemstones, moving eyes, or other decorative or useful attachments. The surface material 31 may also contain areas which are made of different material, such as imitation fur or other touch distinguishing material. The greeting card 300 may also contain a sentiment panel 31C which is attached along a fold line to the surface material 31 on the front or the back of the foam greeting card body 30. Preferably, as shown in FIG. 7, the sentiment panel 31C is attached to the back surface material. Pivoting the sentiment panel 31C away from the foam greeting card body 30 about the fold line may reveal text sentiment, photos, graphics or a combination thereof, typical of a traditional greeting card. The sentiment panel 31C may be made of the same or different material from the front and back surface material 31.

A sound module is contained within the one or more cavities contained in the foam body 30. The sound module is operative to store and replay one or more audio files and may contain, but is not limited to: a circuit board 32; an integrated circuit chip; a digital storage device; a speaker 33; a power source such as batteries 34; a switch; and any other electrical, mechanical or electromechanical component which facilitates the storage and playback of digital audio or that may effectuate other special effects such as lighting or movable parts. The greeting card 300 shown in the figures contains an on/off switch 35 which is accessed through a side perimeter panel of the foam greeting card body 30. The switch may be a push button switch or any other type of switch which controls power to the sound module. Moving the switch 35 from the off position to the on position may initiate playback of a first audio clip. This first audio clip may contain verbal instructions for retrieving additional messages or for replaying additional audio clips. The first audio clip may alternatively play music, movie clips, or any other recordable sound.

The greeting card 300 also contains one or more touch sensitive switches 38, as described above with respect to the previously described embodiments, wherein when a user touches the general area above a touch sensitive switch 38, another audio clip is replayed. The one or more touch sensitive switches can be located anywhere within the foam body below the surface of the front surface material. Touching different areas may cause a particular audio clip to replay or the audio clips may be played in a particular sequence or may be replayed randomly. In the example, shown, the touch sensitive areas 37 of the greeting card 300 are covered with a soft felt or felt-like material and are located directly above or proximate to the touch sensitive plates 38. One area is over the area of the cat's nose and the other areas are in the area of the cat's underside or stomach. Turning the on/off switch 35 to the on position initiates a first audio clip which may be, for example, verbal message telling the user where to touch the cat in order to hear the cat talk. For example, the message may say "touch my nose or tummy to hear me talk". The card recipient is directed by the verbal message but also by the touch sensitive areas 37 on the front surface material 31A, which may be distinguished from the other areas by, as mentioned above, a different type of material. Thereafter, touching one of the indicated areas 37 causes one audio clip to replay. As mentioned above, different areas may cause a specific audio clip to replay or the audio clips may sequentially or randomly play regardless of the contact area. Turning the on/off switch 35 back to the off position disables the playback of the audio clips upon contact with the touch sensitive areas 37. While in the example provided herein, the touch sensitive areas 37 were described as being covered by a different material from the surface material, other indicators may be used to direct the user to the touch sensitive portions of the greeting card, such as stickers, arrows, text or other printed indicia, or any other way by which the greeting card recipient can distinguish the touch sensitive areas 37 of the greeting card 300.

Other switches may be used in addition to or in place of a slide switch, such as a magnetic switch, wherein two magnets are placed on the first and second greeting card panels. When the magnets are in contact, such as when the greeting card is in a closed position, the circuit is broken. When the magnets are no longer in contact, such as when the greeting card is opened, the circuit is completed, triggering playback of the second audio file. Other switches may be used as well such as a light sensitive switch or contact switch.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. An interactive greeting card comprising:

a foam greeting card body having at least one cavity contained therein;

an electronics module contained and concealed within the at least one cavity, the electronics module operative to store and replay one or more audio clips;

one or more capacitance touch switches contained within the at least one cavity and accessed through specific touch sensitive areas on an outer surface of the foam greeting card body, wherein touching the touch sensitive areas causes playback of an audio clip;

wherein the foam greeting card body is shaped like an animal or a person and the audio clip contains a voice impersonating the animal or person after which the foam greeting card body is shaped, and wherein a front sheet material above the one or more capacitance touch switches is covered by a material which is different from the rest of the greeting card.

2. The interactive greeting card of claim 1 further comprising an on/off switch, wherein moving the on/off switch from an off position to an on position causes playback of an audio clip which provides verbal instructions indicating where the touch sensitive areas of the foam greeting card body are located.

3. The interactive greeting card of claim 1, wherein contact with each touch sensitive area triggers playback of a specific audio clip.

4. The interactive greeting card of claim 1, wherein contact with each touch sensitive area triggers playback of audio clips in a specific sequence.

5. The interactive greeting card of claim 1, wherein contact with each touch sensitive area triggers playback of audio clips in random order.

6. An interactive greeting card comprising:

a foam body having a front surface, a back surface opposite the front surface and a perimeter surface therebetween;

a front sheet material attached to the front surface of the foam body;

a back sheet material attached to the back surface of the foam body;

a sound module contained within the foam body between the front and back sheet material, the sound module operative to store and playback two or more unique audio clips;

two or more capacitance touch switch plates placed beneath the surface of the front sheet material, the two or more capacitance touch switch plates operative to trigger playback of the two or more unique audio clips upon user contact with an area above the capacitance touch switch plates;

wherein the front sheet material above the capacitance touch switch plates is covered by a material which is different from the front sheet material.

7. The interactive greeting card of claim 6 further comprising an on/off switch.

8. The interactive greeting card of claim 7, wherein the on/off switch is accessed through the perimeter surface of the foam body.

9. The interactive greeting card of claim 7, wherein movement of the on/off switch from an off position to an on position triggers playback of an audio clip.

10. The interactive greeting card of claim 9, wherein the audio clip contains verbal instructions indicating where the two or more capacitance touch switch plates.

11. The interactive greeting card of claim 6, wherein the foam body is shaped like an animal or character.

12. The interactive greeting card of claim 6, wherein the front sheet material is shaped and decorated like a front view of an animal or character.

13. The interactive greeting card of claim 6 further comprising a sentiment panel attached to the back sheet material which contains text sentiment printed thereon.

14. An interactive greeting card comprising:

a shaped foam body having one or more cavities contained therein;

a front sheet material attached to a front surface of the shaped foam body;

a back sheet material attached to a back surface of the shaped foam body;

a perimeter wall between the front and back surface of the shaped foam body;

a sound module contained within the one or more cavities in the shaped foam body, the sound module operative to store and playback at least one audio file;

an on/off switch accessed through the perimeter wall;

a plurality of capacitance touch switch plates located below the front sheet material;

wherein user contact with an area above the plurality of capacitance touch switch plates triggers playback of the at least one audio file, when the on/off switch in is an on position; and wherein a material which is different from the front sheet material covers the areas above the front sheet material and plurality of capacitance touch switch plates.

15. The interactive greeting card of claim 14, wherein the front sheet material above the plurality of capacitance touch switch plates can be distinguished from the other areas of the front sheet material.

16. The interactive greeting card of claim 14, wherein the front sheet material above the plurality of capacitance touch switch plates is covered by a material different from the front sheet material.

17. The interactive greeting card of claim 14, wherein movement of the on/off switch from an off position to an on position triggers playback of an audio clip instructing a user where to touch the greeting card to hear an additional message.

18. The interactive greeting card of claim 14, wherein the front and back sheet material is shaped in the form of the foam body.

19. The interactive greeting card of claim 14, wherein contact with each of the plurality of capacitance touch switch plates triggers different audio clips.

* * * * *